United States Patent [19]

Dickinson

[11] 4,433,783

[45] Feb. 28, 1984

[54] SOAP POWDER PACKAGE

[76] Inventor: Robert H. Dickinson, 1132 Winding Dr., Cherry Hill, N.J. 08034

[21] Appl. No.: 104,039

[22] Filed: Dec. 17, 1979

[51] Int. Cl.[3] ..... B65D 27/08; B65D 85/00; B65D 30/22

[52] U.S. Cl. ..... 206/484; 206/77.1; 206/525; 383/38; 383/100

[58] Field of Search ..... 206/77.1, 484, 525; 229/56, 62.5

[56] References Cited

U.S. PATENT DOCUMENTS 2,976,988 3/1961 Schneider ..... 206/484
3,204,760 9/1965 Whiteford ..... 206/484
3,207,420 9/1965 de J. Navarrete-Kindelan ... 229/56
3,809,224 5/1974 Greenwood ..... 229/56

*Primary Examiner*—William T. Dixson, Jr.
*Attorney, Agent, or Firm*—Bauer & Amer

[57] ABSTRACT

A heat sealed package for soap powder, stored therein as a layer, and prevented from shifting therefrom into a concentrated mass by compartment-delineating additional heat seals. Said additional heat seals are intentionally provided in spanning relation across the package with a small length portion unsealed, so that a passage is provided in said unsealed portion for any trapped air to displace to another location under an external pressure, rather than contribute to rupturing the package.

1 Claim, 3 Drawing Figures

SOAP POWDER PACKAGE

The present invention relates generally to a soap powder premium package, and more particularly to a rupture-proof or resistace paper package for soap powder that can effectively be used as an insert for newspapers, magazines, or mailed, because of its ability to withstand the normal abuse of such use.

As understood, advertising and product promotion often contemplates supplying potential customers with product samples in the hope that satisfactory use will encourage future purchases of the product. As further understood, a particularly desirable method of distributing the product is as an insert to a newspaper or magazine. A typical washing load sample of soap powder, i.e. a half cup or four ounces, meets the product requirements of being lightweight and otherwise ostensibly suitable to be distributed in the desirable manner noted, but heretofore was not effectively so distributed undoubtedly because of the difficulty of enclosing it in a sufficiently rupture-resistant package. For example, a conventional heat sealed enclosure or pouch will not prevent the shifting concentraction of the powder contents, and thus a condition contributing to the rupturing thereof. The concentrated powder in such a package also produces an unacceptable bulge, further disqualifying its use as a newspaper insert or the like.

Broadly, it is an object of the present invention to provide a heat sealed package for soap powder to be distributed as a premium overcoming the foregoing or other shortcomings of the prior art. Specifically, it is an object to provide improved packaging for said soap powder in the specific form as a spread or layer, and effective to maintain such product in this form during distribution as a magazine insert, mailing piece, or in similar circumstances in which it is subjected to considerable handling.

A soap powder rupture-proof package formed of paper construction material demonstrating objects and advantages of the present invention includes a cooperating pair of front and rear heat sealable panels arranged on opposite sides of the soap powder spread out as a layer and heat sealed along their peripheral edges to thereby form a storage compartment for the layer of soap. To complete the package use is made of plural position-retaining heat seals additionally joining the front and rear panels to each other applied in spaced apart relation therealong so as to correspondingly delineate the storage compartment into subcompartments to thereby minimize the shifting concentration of the stored layer of powder within said compartment. Each said position-retaining heat seal extends in spanning relation between an opposing pair of peripheral heat seals only for most but not all of the distance therebetween to thereby form a communicating air passage between the sub-compartments in the unsealed distance left between said position-retaining heat seals and said peripheral heat seal in adjacent position thereto. As a result, any external pressure applied against any air trapped in the package during the sealed enclosure of the soap powder is merely displaced to another location, rather than contributing to the rupture of the package.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

In advertising and product promotion it is desirable to supply potential customers with product samples in the hope that satisfactory use thereof will induce further purchases of the product. This is particularly true in the case of soap powder. The typical volume for product sampling would be approximately a half cup or four ounces, the amount necessary for a typical washing load. To merely supply four ounces of soap powder in a heat sealed pouch, however, is not satisfactory since the powder has a tendency to shift, and thus to concentrate in one location and in this and other ways renders the package very vulnerable to rupture. Another additional weakness of such a pouch or package worth noting is the tendency of any air trapped within the package during the sealing of the soap powder therein to cause bursting or rupture under an externally applied pressure or load.

Overcoming the foregoing and other shortcomings of the prior art, the improved package for soap powder according to the present invention is a heat sealed container formed of paper construction material, and thus not inherently strong, and yet resistant to a noteworthy extent to any tendency to rupture. Stated another way, the within improved soap powder package is practically rupture-proof, and this characterizing feature is due to its unique structural features rather than to the use of admittedly strong, but costly, construction material, all as will now be explained in detail.

Figure 1:
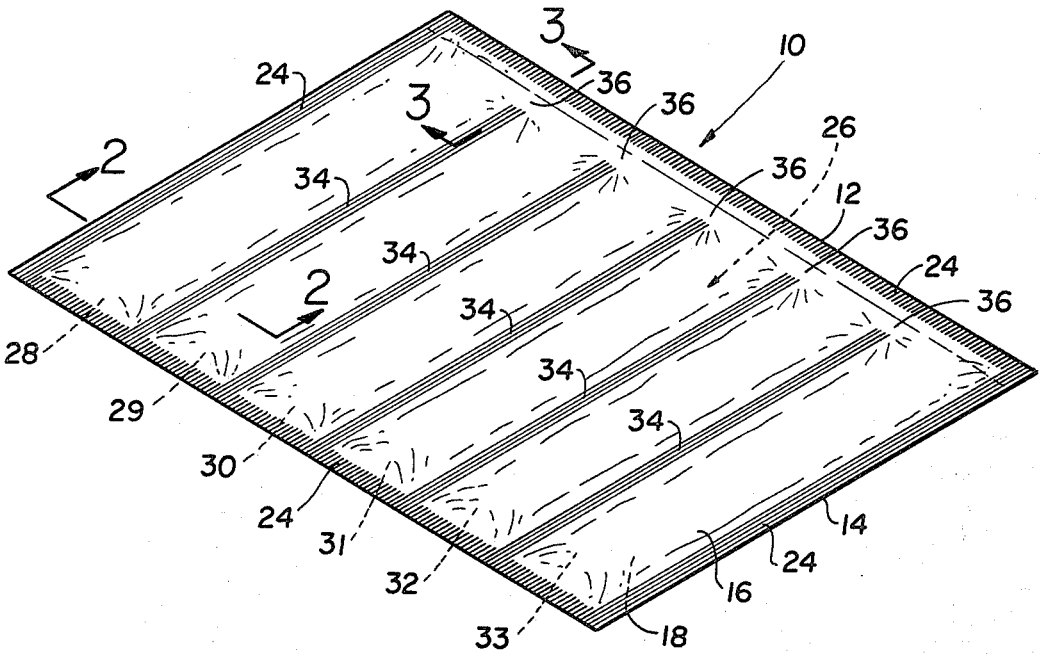
FIG. 1 is a perspective view of an improved soap powder package according to the present invention.

As illustrated in FIG. 1, the within improved soap powder package, generally designated 10, has an essentially flat configuration and, in a preferred embodiment, is of a rectangular shape in which the long side 12 is approximately 11 inches and the short side 8 inches. Package 10 of the dimensions just noted provides an internal compartment adequate for storage of four ounces of soap powder spread out in a layer, or the like.

The structural features of package 10 which render it rupture-proof, at least for all practical purposes, will now be specifically noted. More particularly, package 10 is comprised of a cooperating pair of front and rear panels 16 and 18, respectively, in the rectangular shape and dimensions previously noted. The inner surfaces 20, 22 of these panels (see in particular FIG. 2) have appropriately adhered thereto a heat sealable plastic so that when the panels 16 and 18 are operatively arranged in facing relation to each other peripheral heat seals, individually and collectively designated 24, are readily applied along the four sides of the package to form an internal compartment, designated 26 in FIG. 1, between the panels 16 and 18.

Before the application of the peripheral seals 24, however, it will be understood that the four ounces of soap powder 38, spread out as a layer, is in an operative interposed position between the panels 16 and 18 so that the application of the peripheral seals 24 effectively encloses said powder in compartment 26, thus forming the heat sealed package 10.

Without additional structural features, however, the package 10 as above described will soon rupture under the stress of handling during distribution to the customer, whether the distribution is by way or mailing, or as an insert to a magazine or newspaper, or similarly distributed. One principal reason, as already noted, is that the powder tends to shift and thus concentrate in one location, thus placing stress in the area of the panels 16 and 18 coincident with such location. Also, during the application of the peripheral seals 24, there is always invariably trapped air within the package 10. Any external pressure applied against this trapped air has a tendency to produce a bursting or rupture in the package. To obviate the foregoing and other shortcomings, the package 10 is thus imparted with those structural features, as are more particularly illustrated in FIGS. 2 and 3, which eliminate all major causes of rupture therein. More particularly, package 10, or more accurately, compartment 26 thereof, is subdivided into six sub-compartments designated 28–33, inclusive. In accordance with the present invention, this is achieved by applying additional heat seals, individually and collectively designated 34, in the transverse orientation and spaced apart relation as illustrated. In practice it has been found that the application of the heat seals 34 is effectively completed despite the presence of the soap powder in interposed position between the panels 16 and 18. It is also important to note that each heat seal 34 is applied in spanning relation only for nearly all but not the complete distance between the opposing peripheral seals 24 applied along the long dimension of the package 10. In other words, at each end of the heat seal 34 there is an unsealed distance 36, approximately ⅝ths of an inch, the significance of which will now be explained.

Figure 2:
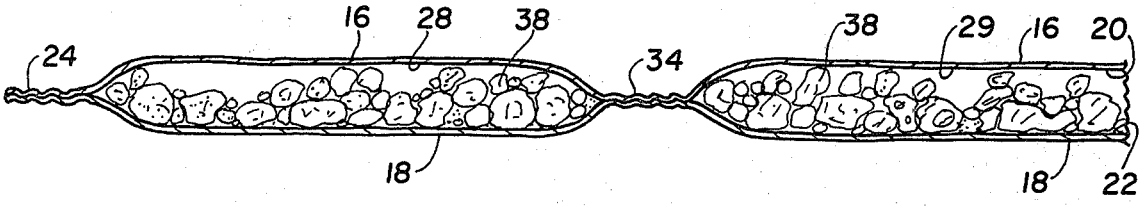
FIG. 2 is a partial side elevational view, on an enlarged scale, in section taken along lines 2—2 of FIG. 1, illustrating further structural details.

First, referring to FIG. 2, it should be noted that the effect of forming the said compartments 28,29, etc. out of the main compartment 26 prevents the stored soap powder 38 from shifting, and thus significantly concentrating in any one location. To this extent, therefore, the heat seals 34 function as position-retaining structure as far as the layer of soap powder 38 is concerned.

Figure 3:
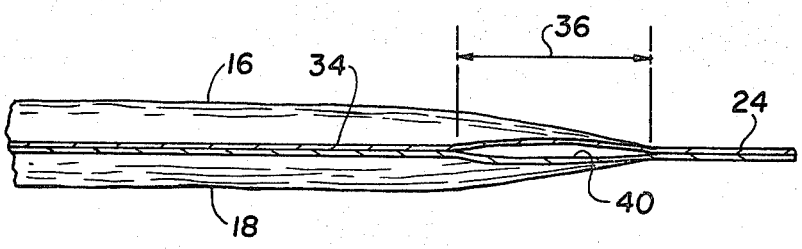
FIG. 3 is also an enlarged partial and sectional view in section taken along line 3—3 of FIG. 1, illustrating the internal air passage feature of the within package.

Referring now to FIG. 3, the effect of leaving an unsealed distance 36 results in the unsealed portions of the panel bounding a communicating air passage 40 between each and all of the sub-compartments 28–33. As a result, any externally applied pressure against any trapped air merely results in the displacement of the trapped air to another location through the communicating air passage 40. As a result the trapped air has little or no tendency to cause any bursting or rupture in the package 10.

From the foregoing, it should be readily appreciated that package 10 constitutes an inexpensive but nevertheless effective mailing or distribution container for soap powder in that it has little or no tendency to rupture due to product shifting or in response to the influence of externally applied pressure.

A latitute of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A rupture-proof package formed of paper construction material for soap powder comprising a cooperating pair of front and rear rectangular panels presenting opposite long and short dimensioned sides arranged in superposed relation and having heat sealable surfaces in facing relation to each other, a rectangular peripherally applied heat seal for joining said front and rear panels to each other so as to bound therebetween a correspondingly rectangularly shaped storage compartment for a layer of soap powder having an operative interposed position therebetween prior to the application of said peripheral heat seal, and five position-retaining heat seals additionally joining said front and rear panels to each other applied in spaced apart relation along said long dimension of said package so as to correspondingly delineate said compartment into six sub-compartments each oriented lengthwise in said short dimension thereof to thereby minimize the shifting concentration of said stored layer of powder within said compartment, each said position-retaining heat seal extending in spanning relation between an opposing pair of said long dimensioned peripheral heat seals only for most but not all of the distance therebetween to thereby form at least one communicating air passage extending in the long dimension of said package between said sub-compartments in the unsealed distance left between said position-retaining heat seals and said peripheral heat seal in adjacent position thereto, whereby any external pressure applied against any air trapped in said package during the sealed enclosure of said soap powder is merely displaced to another location rather than contributing to the rupture of said package and any select number of less than said six sub-compartments are adapted to be opened for removal of the contents therefrom by merely severing said package in said long dimension thereof in said unsealed distance and for an extent corresponding to said select number of sub-compartments.

* * * * *